United States Patent [19]

Talbot

[11] 4,228,640

[45] Oct. 21, 1980

[54] SIMULATED SPUN-LIKE INGRAIN YARN

[75] Inventor: James R. Talbot, Charlotte, N.C.

[73] Assignee: Fiber Industries, Inc., Charlotte, N.C.

[21] Appl. No.: 8,640

[22] Filed: Feb. 1, 1979

Related U.S. Application Data

[60] Division of Ser. No. 839,955, Oct. 6, 1977, Pat. No. 4,164,117, which is a continuation-in-part of Ser. No. 674,350, Apr. 7, 1976, Pat. No. 4,060,970.

[51] Int. Cl.[3] ..... D02G 3/34; D02G 1/20

[52] U.S. Cl. ..... 57/208; 57/245; 57/247; 57/908

[58] Field of Search ..... 57/3, 6, 244, 245, 246, 57/247, 248, 288, 290, 328, 231, 350, 351, 908, 205, 210, 227, 228, 207, 208, 289

[56] References Cited

U.S. PATENT DOCUMENTS

| | | | |
|---|---|---|---|
| 3,017,737 | 1/1962 | Breem | 57/350 |
| 3,041,812 | 7/1962 | Marshall | 57/350 |
| 3,043,088 | 7/1962 | Breem | 57/350 |
| 3,091,912 | 6/1963 | Stoddard et al. | 57/247 |
| 3,103,098 | 9/1963 | Dyer | 57/908 X |
| 3,104,516 | 9/1963 | Field | 57/350 X |
| 3,110,151 | 11/1963 | Bunting et al. | 57/908 X |
| 3,296,785 | 1/1967 | Hardy | 57/350 |
| 3,425,893 | 2/1969 | Sims | 57/248 |
| 3,460,336 | 8/1969 | Collingwood et al. | 57/351 X |
| 3,529,323 | 9/1970 | Hugbey | 57/248 |
| 3,534,540 | 10/1970 | Collingwood et al. | 57/908 X |
| 3,593,513 | 7/1971 | Reese | 57/244 |
| 3,724,199 | 4/1973 | Armstrong et al. | 57/350 X |
| 3,785,135 | 1/1974 | Seem et al. | 57/289 |
| 3,785,136 | 1/1974 | Teece et al. | 57/290 |
| 3,824,776 | 7/1974 | London | 57/245 X |
| 3,973,386 | 8/1976 | Gnofa | 57/288 X |
| 3,988,883 | 11/1976 | Sze | 57/245 X |
| 4,016,715 | 4/1977 | London | 57/908 X |
| 4,051,660 | 10/1977 | Griset et al. | 57/350 X |

*Primary Examiner*—Donald Watkins
*Attorney, Agent, or Firm*—Herbert M. Adrian, Jr.

[57] ABSTRACT

A method for producing ingrain spun-like yarn simulating a blended staple yarn is described wherein continuous filament yarn is produced which has characteristics similar to blended staple spun yarns. Fabrics made from the yarns described herein provide a fine grained heather appearance without the normal moiré or plaiting effect seen in previous ingrain continuous filament yarn fabrics. The unusual continuous filament yarn described herein is made by a texturing process which involves the combination of two or more differently dyeable continuous synthetic yarns which are false twist textured followed by overfeeding to an air bulking means. The preferred method utilizes false twist texturing of synthetic filaments such as polyester, nylon, cellulose acetate or cellulose triacetate and mixtures thereof wherein two differently dyeable yarns are combined with an air bulking jet interposed to act on the false twist textured yarn while it has a high residual torque and subsequently decaying said torque.

8 Claims, 3 Drawing Figures

SIMULATED SPUN-LIKE INGRAIN YARN

This is a division of U.S. application Ser. No. 839,955, filed Oct. 6, 1977 and now U.S. Pat. No. 4,164,117, which is a continuation-in-part of U.S. application Ser. No. 674,350, filed Apr. 7, 1976 and now U.S. Pat. No. 4,060,970.

BACKGROUND OF THE INVENTION

For many years, the textile industry has sought ways for producing yarns from continuous filaments such that the yarns have the characteristics of a spun yarn comprised of staple. Prior to the advent of synthetic filaments, all yarns were produced from staple products. Synthetic filaments, however, are made as continuous filaments and, in order to provide the desirable effects of staple products, a vast proportion of synthetic filament production is cut into staple length fibers. Such fibers are then twisted into yarns, called spun yarns.

Spun yarns have a particularly desirable characteristic of being somewhat fuzzy or hairy along their length giving them the desirable attributes of softness and cover and, when produced into fabrics, the ability to produce low density, porous, permeable and comfortable materials. Continuous filament yarns also have many desirable attributes but they also have their limitations, particularly in respect to bulk, cover and comfort factors. Nevertheless, continuous filament yarns have replaced spun yarns in many end uses. Of course, it is obvious that if a continuous filament yarn could be made into a spun-like yarn, the otherwise expensive steps of cutting continuous fibers into staple followed by carding, coning and twisting into roving, followed by drafting and twisting further into yarns could be eliminated.

Many attempts have been made to accomplish this feat but various limitations in the resulting product have kept such continuous filament yarns from being complete replacements for spun yarns. In particular, previous methods, such as the very popular false twist texturing method for crimping continuous filament yarns to produce bulk and cover, have had their limitation in that the yarns always end up having a rather synthetic feel and look. This is probably due to the lack of the fuzzy and hairy projections which are present in spun yarns.

Another attribute staple yarns have is the ability to blend different fibers of different dyeability, such as polyester and wool or polyester and cotton, to produce a heather effect when dyed. Many suggestions have been made for combining filament yarns but such previous attempts have failed to effect an adequate blending of the fibers such that the yarns would equal the appearance of staple in fabric form. The lack of a total intimate blending results in an undesirable moiré or plaiting appearance in the resulting fabric.

An additional problem is also encountered in producing ingrain filament yarns. The best blending was previously accomplished by combining the different yarns prior to drawing and then drawing the yarns as a single combined yarn. Different yarns, however, require different drawing tensions or ratios such that the best dyeing results would in turn require a matching of the ultimate drawing tension. This in turn would require different spinning conditions such that the drawing tensions could be matched and therefore the two yarns could not be co-spun for optimum results. The present method minimizes or negates the critically of matched drawing tensions in the draw texturing step.

It is an object of the present invention to produce a simulated spun-like ingrain yarn which is made from continuous filaments and does not have the disadvantages of the prior art.

It is another object of the present invention to produce a spun-like ingrain yarn which has high knitting and weaving efficiencies.

It is yet another object of the present invention to provide a spun-like ingrain yarn which has substantially different characteristics from previous bulked yarns while at the same time having the desirable characteristics of staple blend spun yarns.

It is a further object of the present invention to provide an ingrain filament yarn which, in fabric form, dyes to a fine grain heather appearance.

These and other objects of the present invention will become apparent to those skilled in the art from a reading of the present description.

THE INVENTION

In accordance with the invention, there is provided a process for producing continuous filament spun-like ingrain yarn comprising combining two differently dyeable synthetic continuous filament yarns, false twist texturing said combined yarn to produce a torque lively yarn, overfeeding said textured yarn to a high velocity gaseous jet to convolute individual filaments in the yarn to form a plurality of torque induced kinks, preferably heat treating said yarn to reduce the torque and subsequently winding said yarn onto a package.

The continuous filament spun-like yarn of the present invention comprises a multifilament synthetic yarn wherein individual filaments are longitudinally in a helical configuration with periodic reversals of extended helix direction along their length, said individual filaments additionally having torque induced kinks and twisted loops in random distribution along the length of said yarn, said yarn being held together as an integral bundle by the intermingling of the respective individual filaments. The yarns of the present invention can be produced from any continuous synthetic filament including but not limited to polyester, nylon, cellulose acetates, cellulose triacetates, acrylics, modacrylics and mixtures thereof.

A particular advantage of the present invention is that known and extensively used texturing equipment can be modified in accordance with the present invention to produce the present yarn. Consequently, large expenditures of capital are not required. This is particularly advantageous because it gives flexibility to a yarn throwster to produce a variety of different yarns which are very distinct, one from the other.

DETAILS OF THE INVENTION

The invention will be more fully described by reference to the drawings in which.

The ingrain yarn of the present invention is made by combining two or more differently dyeable filament yarns. The different dyeability can be attained by:

(1) using different polymers such as nylon and cellulose acetate or polyester and nylon or polyester and cellulose acetate, etc., or (2) modifying the same basic polymer to give any combination of disperse dyeability, acid dyeability, cationic dyeability or melt or solution colored.

It is well known that polymers such as polyester, nylon and the like can be modified or enhanced by additives or coreactants to place additional or different dye sites in the polymer. Most fibers are spun as clear or white fibers but they can also be spun already colored by the addition of dyes or pigments to the spinning melt or solution.

The yarns of the present invention can be co-spun at the same spinning speeds even though the different polymer varients result in different spun birefringences because, in the process of producing the final textured yarn, the different fiber polymers are so thoroughly mixed that any mismatching of birefringence or drawing tension is masked in the resulting yarn so that dyeing differentials are not noticeable. This is a particularly valuable advantage of the present invention. However, it may be desirable to separately spin the different fibers due to the fact that the optimum spinning conditions may be different for the different fibers.

The different fibers or yarns are combined into one yarn, preferably prior to drawing and especially prior to texturing. The preferred process utilizes draw-texturing which, by first combining the different yarns, better mixing is obtained. The yarns can be combined in equal or different proportions and of similar or different fiber deniers with similar fiber deniers being preferred. The amount of one yarn being blended with another yarn can range from 10 to 90 percent, with the balance being the other yarn. Ratios of 20/80, 30/70, 40/60 and 50/50 are frequently used to obtain fabric varients ranging from subtle heather to more pronounced heather appearances.

Figure 1:
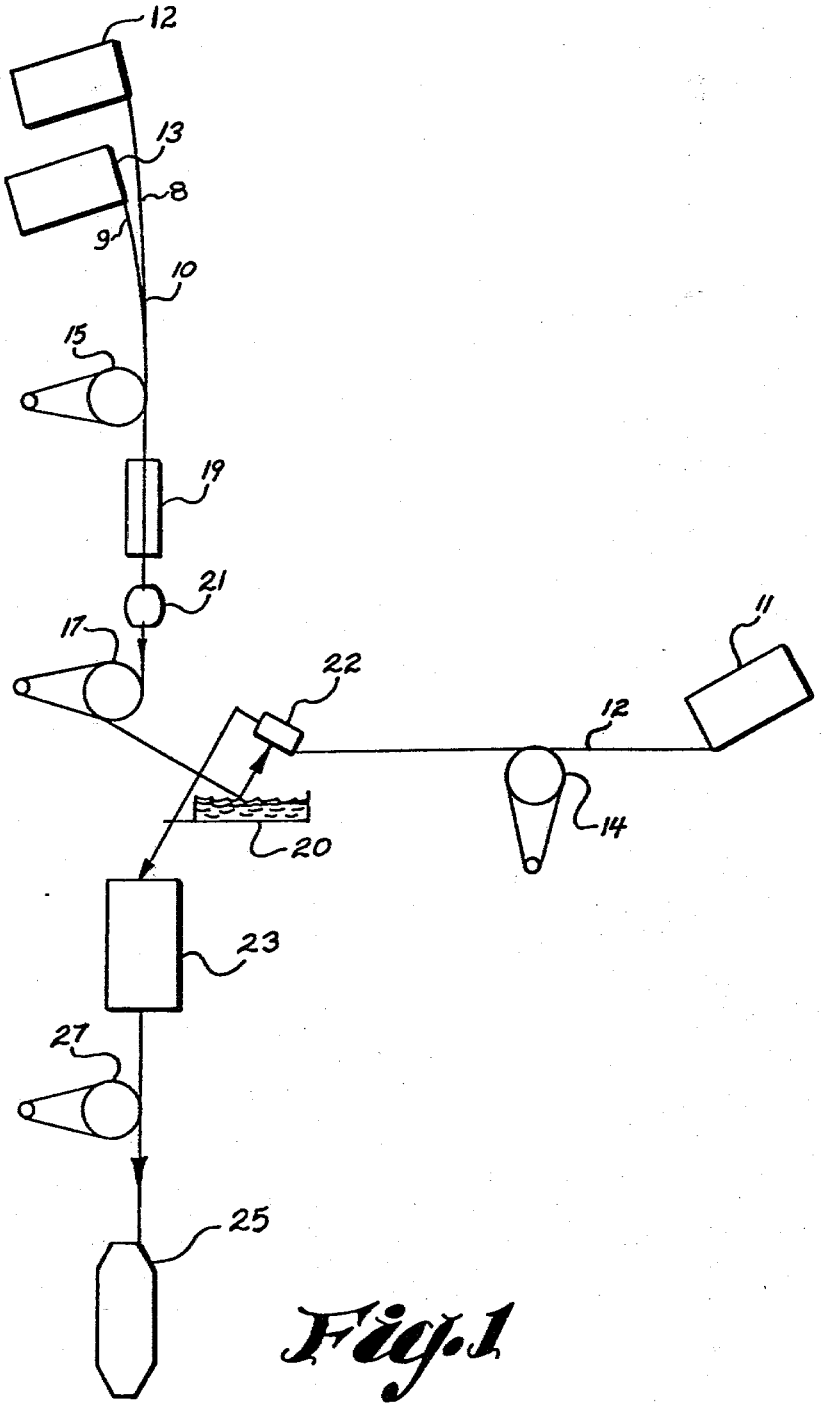
FIG. 1 is a schematic view of the process of the present invention.

Referring more particularly to FIG. 1, a typical draw texturing schematic is shown wherein feed yarns 8 and 9 are withdrawn from packages 12 and 13 and combined to form yarn 10 prior to passing over feed roll 15 and across heat setting zone 19 and through twisting means 21. Twisting means 21 rotates yarn 10 to a highly twisted state wherein the twist backs onto heating means 19 wherein the twist is set. As the yarn is drawn through the twisting means 21 by draw rolls 17, it is untwisted. The untwisted yarn is then fed through bulking means 22 in a substantial overfeed which is determined by the different speeds between draw rolls 17 and takeup rolls 27. Preferably, prior to reaching takeup roll 27, the yarn is heat set by heat means 23. As the yarn passes from takeup rolls 27, it is taken up on package 25 in the conventional manner.

The noted schematic is typical of that utilized in draw texturing, although the present process can be utilized without a simultaneous drawing and texturing step. In draw texturing, a differential speed is set between feed roll 15 and draw roll 17 such that draw roll 17 operates at a higher speed than feed roll 15. The difference in the speeds determines the draw ratio. When fully drawn yarn is utilized, feed roll 15 and draw roll 17 may be operated at about the same peripheral or linear speed. Slight variation in peripheral speed may be desirable depending upon tensions utilized in the twisting area.

Although FIG. 1 illustrates yarns 8 and 9 being withdrawn from separate packages, the different yarns could desirably be co-spun, as noted above, from the same spinneret or in a side-by-side arrangement. Consequently, FIG. 1 is illustrative of a typical process with yarns 8 and 9 representing the different feed yarns constituting the ingrain of the present invention.

Heating means 19 is preferably a heated plate but could be a hot pin, heated roll, steam chamber, hot air oven or the like heating means which are capable of heating the yarn above the second order transition temperature and preferably to the desired heat setting temperature of the yarn such as 180 to 250 degrees centigrade for polyester. The critical temperature in the process is the temperature that the yarn reaches, which temperature is referred to herein. The heating means per se can, and often is, at a temperature greatly in excess of the temperature which the yarn actually contains. Such heater temperatures can well be in excess of the yarn melting temperature, with the speed of the yarn being sufficiently high to prevent melting of the yarn.

Twisting means 21 can be any of the numerous known twisting devices which are capable of inserting the desired degree of twist into the yarn at the linear speed at which the present invention is utilized. Such twisting devices are capable of putting in a wide range of twist levels per inch up to as much as 200 twists per inch (t.p.i). The present process, however, preferably utilizes a lower t.p.i. than would be desirable in conventional false twist textured yarn. Consequently, twisting means, which are capable of inserting the preferred twist level of 5 to 60 t.p.i., and more preferably 15 to 45 t.p.i., can be utilized.

Because of the generally lower twist level used, spindle twisters can be utilized even at fairly high texturing speeds, because with the lower t.p.i. inserted, the speed of yarn can be greatly increased over conventional process speeds. The desired yarn processing speed thus becomes limited, not by the speed of the twister, but rather by the capability of the bulking jets which are utilized. Although friction twisters can be conveniently utilized, spindle twisting means are often preferred because a lower twist per inch is more readily controlled with spindles. Friction twisting means, however, are normally capable of much higher linear speeds than spindle twisters for the same inserted twist and therefore are preferred for higher productivities.

The amount of twist put into the yarn is dependent on the yarn denier and the desired amount of subsequently inserted projecting kinks. Thus, for low denier, higher twist levels are normally used while for higher deniers, lower twist levels are often desirable. The most desirable twist level ranges for various yarns can be expressed by the equation:

$$\frac{400 \pm 340}{\sqrt{\text{denier}}} = \text{twists per inch}$$

wherein denier is that as measured at the draw roll.

The most preferred range is in accordance with the equation:

$$\frac{400 \pm 150}{\sqrt{\text{denier}}} = \text{twists per inch}$$

These equations represent a preferred twist level range of about 5 to 7 t.p.i. and more preferably about 19 to 42 t.p.i. for 170 denier.

The feeder yarn of the present invention can be either fully drawn yarn, partially drawn yarn or undrawn yarn. When fully drawn yarn is utilized, no drawing step is effected during the twist insertion and heat setting of the yarn. With partially drawn and undrawn yarn, a draw ratio is applied during the twisting and heat setting step of the yarn. The draw ratio utilized is dependent upon the break elongation of the feeder yarn. With undrawn yarn, the draw ratio effected would be equivalent to a draw ratio which would be utilized in a normal draw texturing operation, i.e., 1.25 to 6 times the fed yarn length.

It is often preferred to use a partially drawn or partially orientated yarn. Such yarns are produced by the high speed takeup of yarn during spinning to thereby develop a birefringence in the yarn. Such partially orientated yarns are most desirably used with polyester yarns wherein a birefringence is developed in the yarn of at least 0.020 up to something less than fully drawn or about 0.100. At the high speed takeup which produces such birefringence, the yarn develops less crystallinity than conventionally drawn yarns such that the crystallinity is normally less than 40 percent and most usually 10 to 30 percent, although the crystallinity can be as low as 0 percent. The yarn, however, does have residual elongations such that further drawing can be effected to reduce the break elongation from an original 50 to 200 percent to a break elongation after draw texturing of about 20 or less percent.

The measurement of birefringence is made by the retardation technique described in "Fibers from Synthetic Polymers" by R. Hill (Elsevier Publishing Co., New York, 1953) at pages 266 to 268. Using a polarizing microscope with rotatable stage together with a Berek compensator or cap analyzer quartz wedge.

Crystallinity may be measured by simple density measurements, for example by the method described in "Physical Methods of Investigating Textiles" by R. Murdith and J. W. S. Hearle (Textile Book Publishers, Inc., 1959) at pages 174 through 176. Other methods are also known for completing these measurements such as when non-round cross sections are used, a dye is present in the fiber or various other additives are present which might effect the measurement methods stated above.

The present feed yarns can be prepared from polyester, such as polyethylene terephthalate, and particularly those polyesters and and copolyesters which contain at least 80 percent polyethylene terepthalate. Additionally, nylon such as nylon 6, which is polycaprolactam; nylon 6,6, which is polyhexamethylene adipamide; nylon 6 T, which is polyhexamethylene terethalamide; nylon 6,12 and the like, as well as cellulose acetates, cellulose triacetates, acrylics, modacrylics, polyvinylidine chloride and the like.

With polymers such as polyester and nylon, the feed yarn is preferably prepared from polymers having an intrinsic viscosity in the range of about 0.45 to 1.0 and more preferably in the range of about 0.55 to 0.80. The intrinsic viscosity is determined by the equation:

$$LM/C \rightarrow O \times NR/C$$

wherein NR is the relative viscosity. Relative viscosity is determined by dividing the viscosity of an 8 percent solution of polymer in orthochlorophenol solvent by the viscosity of the solvent as measured at 25 degrees centigrade. The polymer concentration in the noted formula is expressed as "C" in grams per 100 milliliters.

The synthetic polymers utilized herein may also contain various additives which effect the characteristics of the polymer and resulting fibers such as to improve dyeability, nonflammability, static electrical properties, reduce luster and the like. Such various modifiers, as are conventionally used in such yarns, include chemical and physical modifiers which effect the chemical and physical properties of the fiber. Copolymers of polyethylene terephthalate such as with cationic or anionic dye modifiers and/or with other reactive modifiers such as isophthalic acid, sulfoisophthalic acid, propylene glycol, butylene glycol and the like reactive monomers can be used. Yarns meeting the specific requirements of the present process may additionally or alternatively contain minor amounts of materials used in conventional yarns such as dyesite modifiers, delustrants, polymer modifiers and the like up to 20 percent, but most preferably not more than about 5 percent by weight.

The denier of the yarn as measured at draw roll 17 is preferably in the range of 20 to 1,000, more preferably 50 to 500, and most preferably 70 to 400 total denier. The denier per filament is within the range of 1 to 10.

The cross section of the yarn can have a pronounced effect on the resulting product. Normally, round cross section can be used with good results. However, for the certain desirable effects, a nonround cross section, such as a multilobal cross section, is particularly desirable. Such multilobal cross sections are well known in the art and comprise yarns with regularly or irregularly spaced and shaped lobes. The number of lobes can vary from 3 to 12 or more with 6 to 8 lobes being the most preferred. It has been found that the noted multilobal yarns tend to process more readily into the yarns of the present invention with more efficiency.

The yarn coming from the twister 21 is untwisted as it is passed through the twister and then passed to draw roll 17. Between draw roll 17 and takeup roll 27 false twisted, untwisted, torque-lively yarn is passed through texturing jet 22 in a substantial overfeed. The overfeed is in the range of at least 15 percent up to 70 percent, more preferably 20 to 40 percent, the amount being sufficient to permit retraction of the yarn in jet 22 as it is acted on by the turbulent fluid forces within said jet. The degree of overfeed will control the amount of kinks set into the yarn with greater overfeed, producing greater nunbers of kinks.

Prior to the yarn passing through the jet, it is preferred to moisten the yarn with water. The moisture improves the efficiency of the jet. Moisture can be added to the yarn in numberous ways such as by means of water bath 20, kiss rolls such as are used to apply finishes, various other known finish applicators, mistors, water jets and the like.

Numerous suitable texturing jets are known in the art, such as those described in U.S. Pat. Nos. 2,783,609; 3,097,412; 3,577,614; 3,545,057; 3,863,309; and the like.

The texturing jet used in the present invention is operated at sufficient gaseous pressure so as to separate the individual filaments in the yarn from each other, convolute and whirl said yarns about and, due to the overfeed, slackness of the filaments and the torque liveliness of the yarn and individual filaments cause the individual filaments to twist upon themselves, thereby forming kinks in the individual filaments in the yarn.

The gaseous pressure at which such jets are operated varies with the individual jet and the design thereof. With a commercially available jet, such as that described in U.S. Pat. No. 3,097,412, pressures of 70 to 110 p.s.i.g. at 2 to 5 SCFM give good results. However, the gaseous pressure that is used is that which is sufficient to separate the individual filaments in the jet and permit the turbulent gas and torsional twist action of the filaments of the yarn to form said kinks. Said gaseous pressures and overfeed are also sufficient so that an average, over a one meter length, of at least 5 kinks and/or twisted loops are formed per centimeter of yarn length. The exact number of kinks preferred for a given yarn will vary with aesthetics desired and that will at least partially depend on yarn total denier, denier per filament, inserted twist level, jet overfeed, jet gas pressure and efficiency, yarn throughput speed and the like. The process of the present invention appears to operate with a higher degree of jet efficiency than flat yarn texturing.

A kink, as used herein, is intended to designate a loop formed by an individual filament which is twisted back on itself due to the torque forces of the reversing helix twist running longitudinally along the length of the filament. The base of the loop formed by the filament completes a 360 degree turn such that the filament touches itself at the base of the loop to thereby close the loop. Often the base of the loop is further twisted on itself 0.2 to 4 times to give the appearance of a spiral column at the base of the loop. This is because the torsional forces in the yarn readily forms the kinks when the yarn is opened in the relaxed state. Consequently, with a given jet, much higher linear yarn speeds can be utilized to effect the desired effect with the torque yarn of applicant's process than is required for flat yarn.

The yarn being withdrawn from the jet can be taken up on a package for use without a second heater treatment. For package dyeing and certain weaving applications, it may be desirable to omit the second heater treatment. However, it is preferred, particularly in the case of polyester and nylon yarns, that the yarn be further heat set to further decay the residual yarn torque and to fix the kinks into the yarn. Heat setting is accomplished by passing the yarn from the jet through a second heater 23. The yarn is preferably still in the relaxed state when passed through the second heater but because of the reduction in length of the yarn by formation of the kinks in the jet, the degree of relaxation left in the yarn is on the order of about 5 to 30 percent. The exact amount of residual relaxation in the yarn is dependent upon the overfeed from draw roll 17, the amount of kinks formed in the yarn which, in part, is dependent upon the inserted twist level, the fiber denier, the total yarn denier and the like factors.

The second heater 23 is operated at a temperature which, contrary to conventional false twist texturing, is preferably higher than heating means 19. Such second heater 23 is preferably a hot air oven operated in the range of about 180 to 300 degrees centigrade. The particular temperature utilized is dependent upon the twist setting temperature, the amount of torque decay desired, the degree of relaxation desired, the heat setting time, the degree of tension stability desired and other related factors. Longer heat setting times and higher temperatures will result in a greater degree of set and greater decay of residual torque.

While the yarns produced in the process described have been heretofore directed solely to the continuous processing of flat yarn through false twist texturing and thence jet texturing, it will be recognized by those skilled in the art that the process described can be divided into a series of individual yarn treatments to accomplish the same processing steps. Thus, for instance, one could start with torque lively false twist textured yarn and subject it to the jet treatment described. In the same manner, the process of the present invention can be operated in conjunction with a flat yarn which is not first falst twist textured. Under such conditions, a flat yarn 12 can be fed from another package source 11 to the jet texturing device 22 along with the false twist textured yarn such that the flat yarn is utilized as a core or effect material for the resulting textured yarn. Under such conditions, it may often be desirable to feed flat yarn 12 under a higher tension than the false twist textured yarn to the texturing jet wherein the tension is controlled by feed roll 14. Such a flat core yarn may be desirable, particularly when weaker false twist textured filaments are utilized such as when acetate or triacetate are utilized as the bulking or kink-forming yarn coupled with a stronger yarn such as polyester or nylon which forms the core. Using such conditions, it may be desirable to omit the second heater means because the core yarn can hold the kinked fiber members in position.

As has been pointed out above, the yarn being treated is torque lively and subsequent to the jet entanglement of the yarn, it is preferred to decay the torque. Prior to decaying the torque, it is preferred that the yarn have a torque liveliness in the range of 50 to 130 as measured on the draw roll, i.e., the roll prior to feeding the yarn to the jet, and more preferably in the range of 90 to 120. The decayed torque of the yarn after jet entanglement and heat setting is preferably in the range of 0 to 20 and more preferably 8 to 12.

The torque ranges noted are measured by a simple torque determination which involves counting the number of turns a specific length of yarn will twist when allowed to relax. The test is conducted by positioning a 36-inch length of yarn to be tested horizontally along a measuring stick and securing both ends of the yarn by clamps in a crimp extended fashion. The yarn is tensioned sufficiently to prohibit kinking without stretching the yarn, and clamped into position. A large paper clip weighing $1.565 \pm 0.005$ grams is attached to the center of the clamped yarn. One end of the clamped yarn is moved to meet the other end of the clamped yarn over an interval of two seconds, thereby permitting the yarn to twist and kink. The point at which the clip stops twisting is then noted and the yarn is then re-extended to detwist with the detwisting revolutions of the paper clip being counted to the nearest quarter turn. At least three test lengths of yarn are sampled and the average to the nearest 0.1 turn is recorded as the yarn torque.

Figure 2:
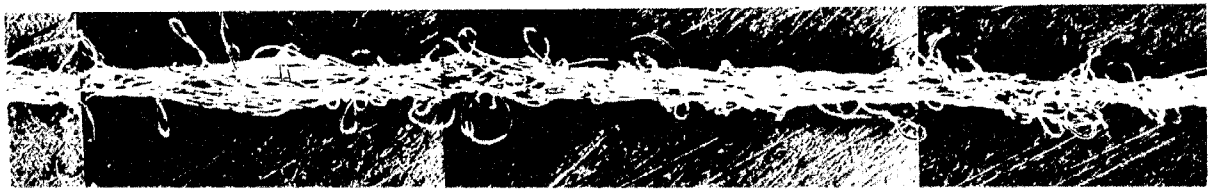
FIGS. 2 and 3 are microphotographs of yarns produced in accordance with the present invention.

FIG. 2 of the drawings represents a typical example of yarn produced in accordance with the present invention. The yarn of FIG. 2 is a 20 magnification composite photomicrograph. The length of the composite shown in FIG. 2 is equal to 1 centimeter of yarn. Examination of FIG. 2 will reveal numerous kinks as described herein wherein individual filaments of yarn loop and twist upon themselves such that more than 5 kinks per centimeter exist in the yarn. As can be seen in the photograph, the actual number of kinks in the yarn is substantially in excess of 5, and consequently the preferred range is at least 5 to about 200 or more kinks per centimeter, more preferably at least 5 to 100 kinks per centimeter.

Figure 3:
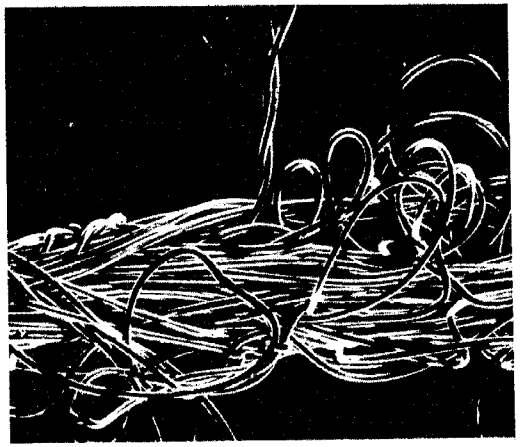

FIG. 3 is another photomicrograph of a segment of yarn of the present invention at 40 magnification. The detailed kinking and entanglement of the yarn is clearly visible and illustrated by several different kinks. The kinks shown span the typical range of twisting of individual filaments upon themselves at the base of the kink from several revolutions to less than a full revolution as has been set forth herein.

The invention will be more specifically described by reference to the following examples which describe certain preferred embodiments and are not intended as limiting the invention. All parts and percentages are by weights unless otherwise indicated.

EXAMPLE I

Ingrain yarns are made in accordance with the present invention utilizing the apparatus as schematically shown in FIG. 1. Various feed stocks are utilized as set forth hereinafter with the processing speeds and conditions as follows for the various feed yarns set forth hereinafter. Two or more feed stocks are combined prior to the feed roll, which is operated at 585 feet per minute, passed across the first heater set at 200° C. through the false twist twister to the draw roll which is operated at 1,000 feet per minute, thus effecting a draw ratio of 1.71. The drawn yarn is then fed through a water bath to a texturing jet operated at 90 pounds per square inch gauge (psig) and an air flow of 3.4 standard cubic feet per minute and hence through a second heater operated at 260 degrees centigrade to the relax roll operating at 756 feet per minute, representing a second heater overfeed of 32.2 percent. The yarn is taken up on a package at a takeup speed of 810 feet per minute.

The feed stock for the process is 290 denier, 60 filament partially orientated polyethylene terephthalate round cross section plied with 70 denier, 9 filament, partially orientated polyethylene terephthalate yarn containing 2 weight percent of 5-sodio sulfoisophthalic acid, a cationic dye enhancing additive. The resulting ingrain yarn has potentially different dyeability due to the cationic ingredient and has the appearance of FIG. 2 with more than 5 kinks per centimeter and tension stable. This yarn comprises approximately 19 percent cationic dyeable polyester and 81 percent disperse dyeable polyester, which, when constructed into fabric and dyed, resultes in a fabric with a wool-like hand and feel and a fine grain heather appearance.

EXAMPLE II

Using the process conditions of Example I and the same feed stocks, the process is changed by separately draw texturing the two feed stocks to their ultimate draw ratio and combining them at the draw roll for subsequent processing in accordance with the present invention. The resulting yarn is very similar to that of Example I. The separate draw texturing of the feed stocks does not significantly effect the final product due primarily to the substantial mixing of the yarns which takes place in the texturing jet.

EXAMPLE III

The process of Example I is repeated with the exception that the water bath is eliminated. It is seen that the jet efficiencies diminish as measured by inserted kinks and yarn tension stability but fully acceptable ingrain yarns are produced.

EXAMPLE IV

The process of Example I is repeated using the same feed stock and process conditions with the exception that the second heater and relax roll is by-passed and the yarn taken up directly on a package. This product has a substantially higher residual shrinkage and is suitable for package dyeing prior to forming into fabric.

EXAMPLE V

The process of Example I is again repeated using as the feed yarns 290 denier, 60 filament, partially orientated polyester polyethylene terephthalate yarn and 70 denier, 90 filament, acid dyeable polyester produced by the addition of a piperazine nylon additive. The resulting yarn has the appearance of FIG. 2 and containes more than 5 kinks per centimeter and is tension stable. This yarn can be cross dyed with acid dyes to produce a fine grain heather effect in the resulting fabrics.

EXAMPLE VI

The process of Example I is again repeated using the stated polyethylene terephthalate 290/60 partially orientated yarn, 85 denier, 13 filament, cationic dyeable polyethylene terephthalate containing 2 percent 5-sodio sulfoisophthalic acid additive and 85 denier, 13 filament, acid dyeable polyethylene terephthalate produced by the addition of a piperazine-nylon additive. The three yarns are combined at the feed roll and processed in accordance with Example I into a tricomponent ingrain yarn. The resulting yarn has the appearance of the yarn illustrated in FIG. 2. This yarn, when constructed into fabrics, gives a wool-like hand and feel and can be cross dyed with a combination of disperse, acid and cationic dyestuffs to produce a fine grain heather appearance.

EXAMPLE VII

The process of Example I is repeated utilizing as feed stock 290 denier, 36 filament, hexalobal polyethylene terephthalate disperse dyeable partially orientated yarn, along with 70 denier, 9 filament, cationic dyeable polyethylene terephthalate containing 2 percent 5-sodio sulfoisophthalic acid. The resulting combination produces a yarn with the appearance of that shown in FIG. 2. This yarn has reduced sparkle and is found to produce kinds more efficiently under the same conditions due to the different cross-sectional characteristics.

EXAMPLE VIII

The feed yarns of the present Example are fully drawn 150/60 disperse dyeable polyethylene terephthalate and 40/9 cationic dyeable polyethylene terephthalate containing 2 percent 5-sodio sulfoisophthalic acid. These yarns are combined at the feed roll and processed using the same conditions as Example I with the exception that the process is not a draw texturing operation. Consequently, the feed roll speed is operated at 990 feet per minute with the draw roll at 1,000 feet per minute, thereby resulting in a draw ratio of 1.01. The other processing conditions remain constant. The resulting yarn is a fully acceptable yarn having the appearance of that shown in FIG. 2 which, when placed in fabric form and dyed, produces a fine grain heather effect.

As can be seen from the various examples, numerous combinations and permutations can be used to produce the desirable ingrain yarns of the present invention which, when woven or knitted into fabrics, produce wool-like and spun-like characteristics. The resulting yarns are tension stable such that the ingrain yarns of the present invention which, when woven or knitted into fabrics, produce wool-like and spun-like characteristics. The resulting yarns are tension stable such that the bulk cannot be pulled out without destroying the yarn. While the examples particularly illustrated polyester, it is recognized that other polymers can be used, as set forth above, with correspondingly good results.

While the invention has been described more particularly with reference to the preferred embodiments, it is recognized that various changes therein can be made without departing from the spirit of the invention. Consequently, it is intended to claim the invention broadly, being limited only by the appended claims.

What is claimed is:

1. A continuous filament spun-like ingrain yarn comprising at least two differently dyeable multifilament synthetic yarns intimately mixed together into a single composite yarn wherein individual filaments are longitudinally in a helical configuration with periodic reversals of extended helix direction along their length, said individual filaments additionally having torque induced kinks and twisted loops in random distribution along the length of said yarn, said yarn being held together as an integral bundle by the intermingling of the respective individual filaments.

2. The yarn of claim 1 wherein the differently dyeable synthetic filaments are selected from the group consisting of polyester, polyamide, cellulose acetate, cellulose triacetate, acrylic, modacrylic and mixtures thereof.

3. The yarn of claim 1 wherein at least one of the differently dyeable yarns is comprised of polyethylene terephthalate.

4. The yarn of claim 3 wherein one of the differently dyeable yarns is a cationic dyeable polyethylene terephthalate.

5. The heat set yarn of claim 1.

6. The yarn of claim 1 wherein one of the differently dyeable yarns is a melt colored yarn.

7. The yarn of claim 1 wherein three differently dyeable yarns are intimately mixed together.

8. The yarn of claim 1 wherein the percentage of each differently dyeable yarn is in the range of 20 to 80 percent of the composite yarn.

* * * * *